United States Patent [19]

Smith et al.

[11] 4,109,390

[45] Aug. 29, 1978

[54] BOW SIGHT

[76] Inventors: Kenneth J. Smith, 5402 Newcastle Dr. SE.; Jerry F. Anderson, 5390 Newcastle Dr. SE, both of Kentwood, Mich. 49508

[21] Appl. No.: 732,508

[22] Filed: Oct. 14, 1976

[51] Int. Cl.[2] ..... F41G 1/46

[52] U.S. Cl. ..... 33/265

[58] Field of Search ..... 33/265; 356/21

[56] References Cited

U.S. PATENT DOCUMENTS

| | | | |
|---|---|---|---|
| 2,574,599 | 11/1951 | Stieber | 33/265 |
| 3,058,221 | 10/1962 | McNeel | 33/265 |
| 3,477,130 | 11/1969 | Egan | 33/265 |
| 3,487,548 | 1/1970 | Frydenlund | 33/265 |
| 3,666,368 | 5/1972 | Sprandel | 33/265 |
| 3,861,051 | 1/1975 | Killian | 33/265 |

*Primary Examiner*—Richard R. Stearns
*Attorney, Agent, or Firm*—Glenn B. Morse

[57] ABSTRACT

A bow sight has a range-finding function that automatically aligns the trajectory path of the arrow to correspond to the range. The range is established by providing a sighting frame that establishes vertically-spaced reference lines that give the apparent height of a known object at a known distance. Rotation of the frame about a horizontal axis reduces the apparent spacing between the top and bottom of the frame, which is correlated to increased distance. As the frame is progressively rotated to the point that the apparent height corresponds to the observed height of the known object, the placement of the sighting frame with respect to the bow is altered vertically to align the bow with the correct trajectory for that distance.

10 Claims, 19 Drawing Figures

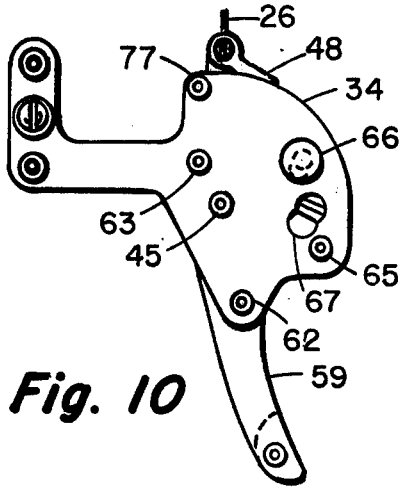
Fig. 10
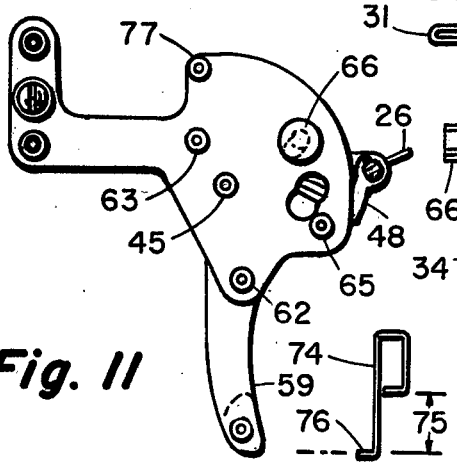
Fig. 11
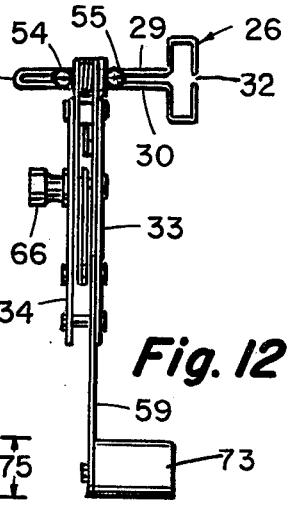
Fig. 12
Fig. 19
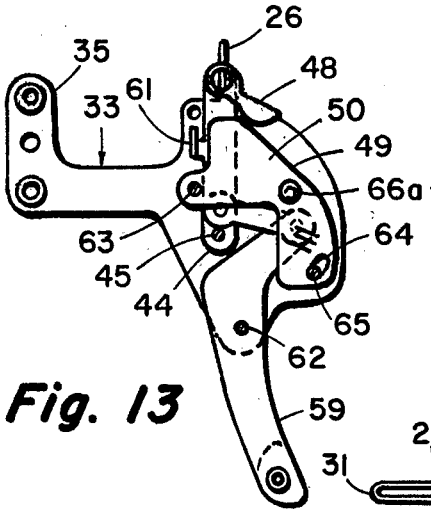
Fig. 13
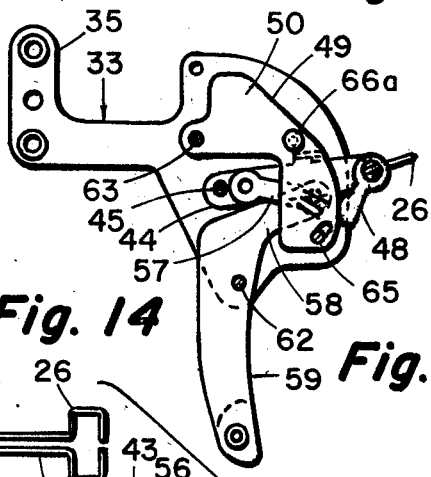
Fig. 14
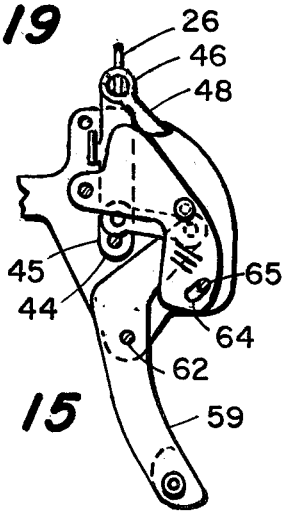
Fig. 15
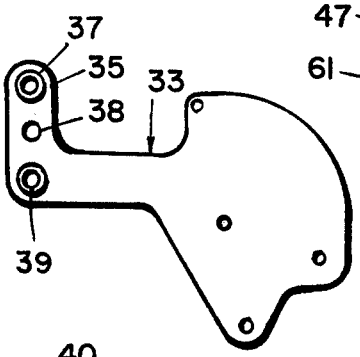
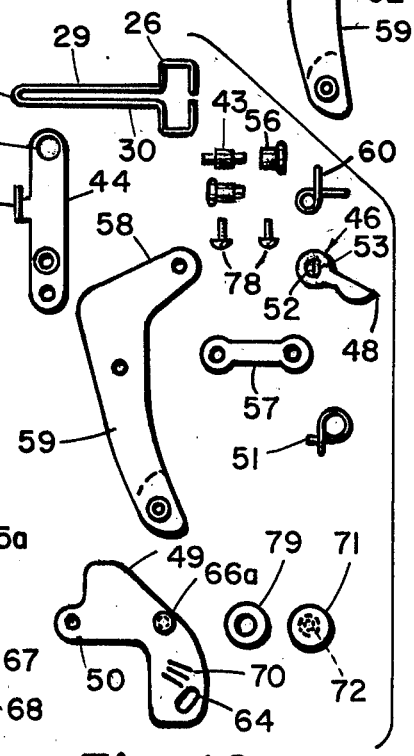
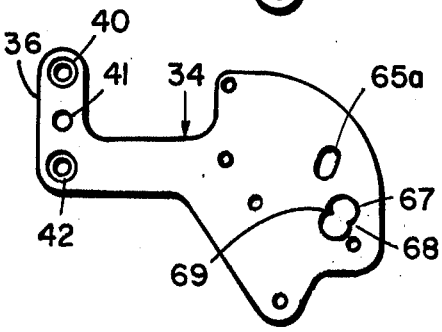
Fig. 18
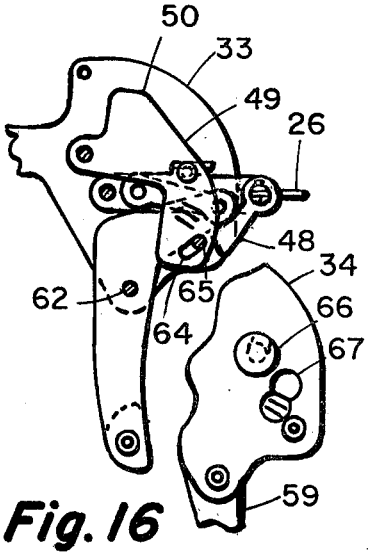
Fig. 16
Fig. 17

BOW SIGHT

BACKGROUND OF THE INVENTION

Much of the skill in archery has necessarily been centered in developing an accurate judgement of distance, combined with a sense of the proper placement of the bow to send the arrow on a trajectory corresponding to that distance. Traditionally, the archer has developed a sort of sixth sense based upon sighting across the tip of the arrow, with the bow held to direct the arrow along a path that the archer intuitively senses to correspond with his judgement of distance. It is common knowledge that a wide range of error is to be expected in making these related judgements. A judgement of distance alone, for example, must often be made instantly, and subject to a number of optical illusions resulting from the presence of surrounding bushes and trees, and the contour of the ground. Movement of the animal being hunted is another complicating factor.

Various forms of sighting devices for bows have been considered for some time, but none of these have done much to reduce the high degree of skill necessary to correlate arrow trajectory and distance judgement, to say nothing of establishing the observed distance to begin with. Most of these devices are primarily a series of vertically-spaced reference lines positioned in such a way that the archer's eye, in sighting across the tip of the arrow, can associate the line of sight with a particular one of these cross-reference lines associated by appropriate marking with stated distances. The archer must first form an accurate judgement as to the distance, and then find the appropriate cross-reference line with his line of sight in order to establish the correct attitude of the bow to launch the arrow on the desired trajectory path.

SUMMARY OF THE INVENTION

The present invention utilizes the fact that the height of the body of an adult deer just behind the front legs does not vary much with the size of the deer. The average height at this point is taken as a known vertical reference, and a sighting frame is mounted on the bow so that the top and bottom of the frame define this reference height at a standard distance, as viewed by the archer's sighting eye in shooting position. The frame is rotatable on a horizontal axis, and such rotation brings the top and bottom of the frame apparently closer together to define the reference height at a greater distance. The required amount of the rotation to match the reference height also produces a vertical movement of the sighting frame with respect to the bow to align the bow for the correct trajectory at this distance.

DESCRIPTION OF THE DRAWINGS

FIG. 10 is a side elevation on an enlarged scale showing the sighting device itself, apart from the bow.

FIG. 11 is a view corresponding to FIG. 10, showing the device in a position corresponding to a distant target.

FIG. 12 is a right-side elevation, with respect to FIG. 10.

FIG. 13 is a view similar to FIG. 10, with one of the side plates of the device removed to expose the interior components in the FIG. 10 position.

FIG. 14 is a view similar to FIG. 13, with the device in the FIG. 11 position.

FIG. 15 is a view similar to FIG. 13, with the adjustment cam displaced from the FIG. 13 position.

FIG. 16 is a view similar to FIG. 14, but with the cam shown in the FIG. 15 position.

FIG. 17 is an enlarged fragmentary side elevation showing the reference indicia for the cam position.

FIG. 18 is an exploded view showing the components of the device.

FIG. 19 illustrates a modified form of sighting frame associated with a less expensive form of the invention.

DESCRIPTION OF THE PREFERRED EMBODIMENTS

Figure 1:
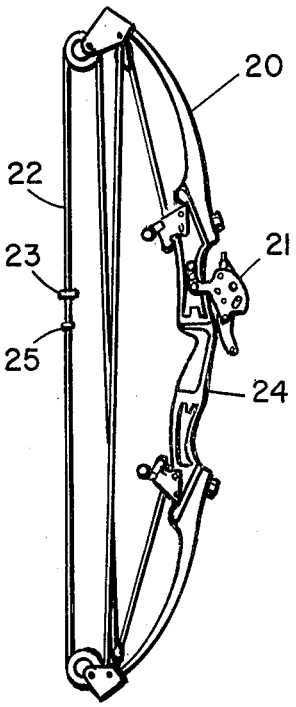
FIG. 1 is a side elevation showing a sighting device embodying the present invention installed on a standard compound bow.
Figure 2:
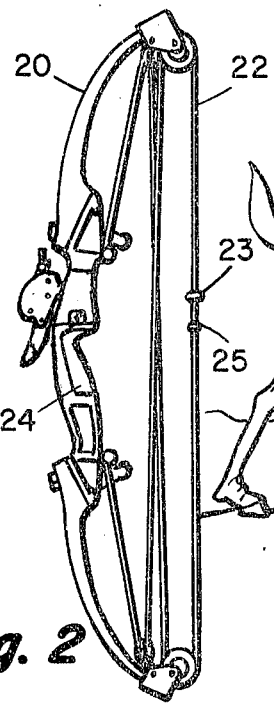
FIG. 2 is a side elevation from the opposite of the unit shown in FIG. 1.

The standard compound bow indicated at 20 in FIGS. 1 and 2 is shown provided with the sighting device 21. It is common practice to provide the bow string 22 with a reference button 23 that the archer will normally place at the junction of his lips to establish the orientation of the bow string with respect to the hand grip 24. Some form of visual reference or string discontinuity is also commonly installed as indicated at 25 to establish the point at which the string is supposed to engage the arrow.

Figure 3:
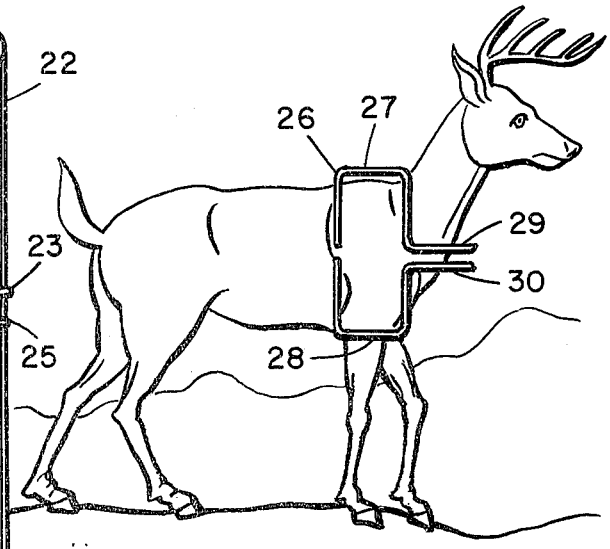
FIG. 3 is a view showing the appearance of a deer, as viewed by the sighting eye of the archer, through the sighting frame of the present device.

The device 21 contains a sighting frame 26 providing vertically-spaced horizontal references 27 and 28 that are intended to bracket the average height of the body of a deer at or just behind the front legs, as shown in FIG. 3, at a known distance. The frame 26 is normally of steel wire, and is attached to the mechanism of the sighting device at the horizontal extensions 29 and 30. The component forming the sighting frame 26 is preferably made from one piece of wire, in which the extensions 29 and 30 form the opposite sides of a bight 31, with a gap preferably being left at 32 to facilitate disengagement of twigs and other foreign material that may become accidentally entrapped in the device.

The structure of the preferred form of the sighting device includes the spaced side plates 33 and 34 forming a structural frame normally secured to a bow by appropriate fastenings traversing the bracket portions 35 and 36 of the side plates respectively. Openings receiving these fastenings are indicated at 37–39 and 40–42, and a spacer as shown at 43 will normally be provided at the openings 38–41 to maintain the spaced relationship of the plates at this point. Generally similar spacing devices will be used at the other openings, depending upon the particular mounting fittings provided on the standard bow 20.

The radius arm 44 is pivotally mounted between the plates 33 and 34 on the pin, or shoulder rivet, 45. This unit may be similar in configuration to that indicated at 43 in FIG. 18. At the outer extremity of the arm 44, a follower 46 is rotatably received within a bushing 47. The follower has a bearing extension 48 positioned to ride on the cam surface 49 of the cam plate 50. A light torsion spring 51 biases the follower 46 in a direction to maintain bearing engagement between the portion 48 and the cam surface 49. The follower also has a pair of opposite axial extensions, one of these appearing at 52 in FIG. 18. These axial extensions are D-shaped in cross section, providing aligned flat surfaces for receiving the portions 29–30 of the sighting frame unit. An axial hole 53 through the central portion of the follower 46 receives this portion of the sighting frame. Screws as indicated at 54 and 55 in FIG. 12 traverse the gap between the portions 29 and 30 of the sighting frame, and engage the axial extensions of the follower to secure the sighting frame in a laterally-adjustable relationship to the device, so that the line of sight through the frame is properly established. It has been found most convenient to produce the follower unit 46 as a molded plastic item, and it is preferable to improve the wear characteristics by applying a metal bushing of the type shown at 56 in FIG. 18 for engagement with the sleeve 47 in the radius arm 44.

Movement of the radius arm from the FIG. 13 to the FIG. 14 position is induced by the action of the link 57 pivotally connected at its opposite ends to the radius arm 44 and to the crank portion 58 of the actuator 59. A return spring 60 biases the radius arm 44 to the FIG. 13 position, acting between the spring seat 61 and the pivot pin 62 that pivotally supports the actuator 59 between the plates 33 and 34. This return spring is positioned at its central coil surrounding the pivot pin 45. The movement of the arm 44 from the FIG. 13 to the FIG. 14 position causes the portion 48 of the follower 46 to follow the cam surface 49 of the plate 50. This cam surface is contoured to provide a particular relationship between the rotation of the sighting frame about a horizontal axis and a vertical displacement induced by the rotation of the arm 44. Obviously, bows of different strength will produce different trajectories, and the position of the cam plate 50 is rendered adjustable to accommodate different bows by providing a pivotal support on the fulcrum 63 secured to the plate 34. The cam plate 50 has an elongated opening 64 embracing the fastening 65 securing the plates 33 and 34 in spaced relationship. The frame plate 34 has an elongated opening **65*a* receiving the adjusting knob 66 secured to the cam plate 50, and capable of being tightened against the plate 34 along the edges of the opening 65*a* to secure the adjusted position. The knob is preferably arranged to be in threaded engagement with the stud 66*a* securely rivoted to the cam plate. The opening 67 in the frame plate 34 provides opposite reference points at 68 and 69 for cooperation with the indicia shown at 70 on the cam plate to show the adjusted position for reference purposes. For smoothness of adjustment, it is preferable to incorporate a bearing washer of a material similar to nylon, as indicated at 71, interposed between the knob 66 and the plate 34. The short cylindrical axial extension 72 on the washer 71 is for interengagement with the slot 65**.

Figure 4:
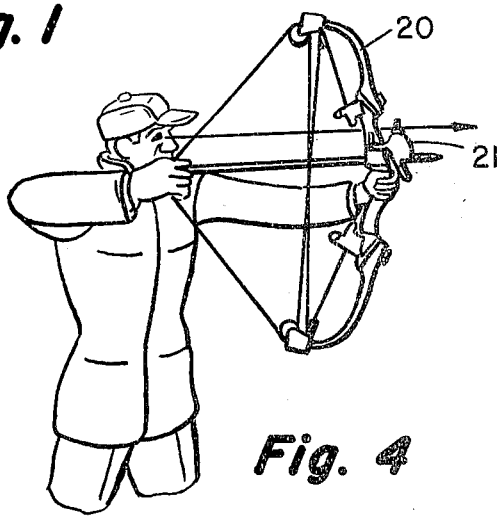
FIG. 4 is a perspective view on a reduced scale over FIGS. 1 and 2, showing the shooting position of an archer.
Figure 5:
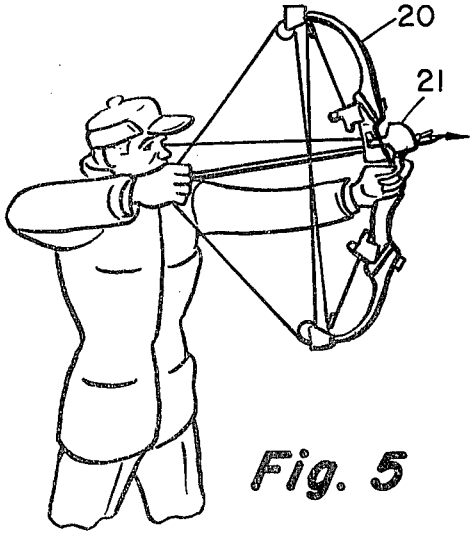
FIG. 5 is similar to FIG. 4, showing the attitude of the bow and the sighting device at an increased distance over that associated with FIG. 4.
Figure 6:
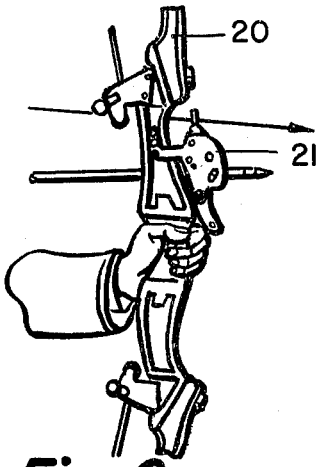
FIG. 6 is a fragmentary side elevation on an increased scale over that of FIGS. 4 and 5, showing the FIG. 4 position.
Figure 7:
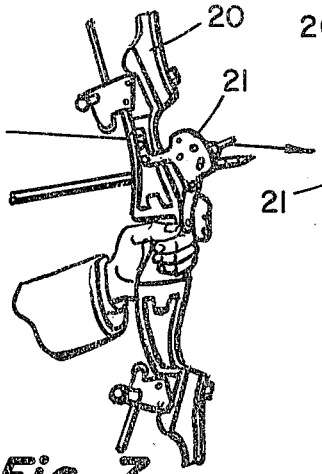
FIG. 7 is a fragmentary perspective on a scale corresponding to FIG. 6, showing the FIG. 5 position.
Figure 8:
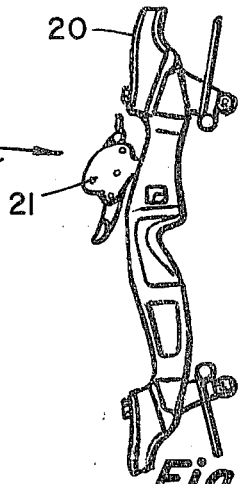
FIG. 8 is a fragmentary side elevation on an enlarged scale, corresponding to FIG. 2.
Figure 9:
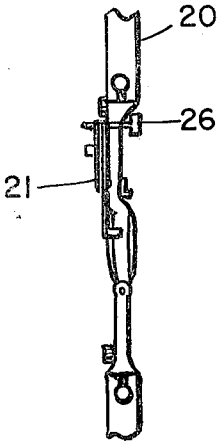
FIG. 9 is a fragmentary front elevation of the bow with the sighting device installed.

The operation of the actuator 59 is accomplished through finger pressure applied to the finger grip 73 secured to the actuator. The placement of this grip should be with such reference to the hand grip 24 of the bow that the index finger of the hand finds the grip 73 in convenient position without distortion of the grip on the bow. Finger pressure applied at this point will thus produce a rotation of the sighting frame 26 about a horizontal axis, with this rotation functioning as a range finder. Vertical movement is also induced as a result of the rotation of the sighting frame 26 about the axis of the pin 45. This latter rotation is entirely a function of the geometrical relationships of the pivot points, whereas the rotation of the sighting frame about the radius arm 44 itself is controlled by the cam surface 49. In general terms, the vertical inclination of the bow appearing as a comparison between FIGS. 4 and 5 will be controlled by the rotation about the pivot point 45, and it should be noted that the sighting frame is eccentric with respect to the axis of the pin 45 in order to accomplish the necessary vertical movement. A simplified and less expensive device incorporating these same principles can be constructed as shown in FIG. 19, in which a sighting frame 74 is disposed at a distance indicated at 75 from a horizontal portion 76 functioning as a rotatable support shaft under the control of an actuator similar to the actuator 59. The distance 75, together with the initial angular position of the frame 74 with respect to the vertical, would be associated with a bow of particular pull characteristics. The result of a device similar to that shown in FIG. 19 would be a less accurate range-finding function than that in which the cam surface 49 is utilized. Occasionally, however, a relatively approximate version may be marketable as a less expensive item. In either form of the device the spaced plates 33 and 34 form a convenient structural base, which can be held in secure relationship at places such as 77 by screws as shown at 78 traversing spacing rings 79. These may also be used as limit stops for the mechanism. Shoulder rivets as indicated at 79 in FIG. 18 can be used best where a pivotal connection does not traverse the plates 33 and 34, such as the connections for the link 57.

We claim:

1. In combination with an archery bow, a bow sight, comprising:

a frame adapted for attachment to a bow adjacent the grip thereof; and a sighting element having reference sections spaced apart a predetermined distance, said element being mounted on said frame by means providing limited rotation about at least one normally horizontal axis between a first position in which said reference sections are disposed in a substantially vertical plane, and a second position in which said reference sections are disposed in a plane angularly displaced from said first plane, wherein the reference sections are moved downwardly as said sighting element moves from said first position to said second position, in such a manner that when sighting to a target having a predetermined height at an unknown distance, the sighting element is moved until the reference sections correspond to the top and bottom of the target, respectively, and when so positioned, the line of sight defined by the space between said reference sections will correspond to the proper angular orientation of the bow to shoot to said unknown distance.

2. A bow sight as defined in claim 1, wherein said sighting element is mounted by said means for relative rotative movement about a plurality of parallel axes.

3. A bow sight as defined in claim 1, additionally including actuating means carried by said frame adjacent the grip of said bow, and adapted to impart the movement of said sighting element.

4. A bow sight as defined in claim 1, wherein the mounting means includes a radius arm pivotally secured to said frame.

5. A bow sight as defined in claim 4, wherein said sighting element is rotatably mounted in said radius arm, and said mounting means further including:

track means mounted on said frame, and follower means operative to rotate said sighting element with respect to said radius arm in response to the contour of said track means.

6. A bow sight as defined in claim 5, additionally including:

an actuating member pivotally mounted on said frame; and link means connecting a portion of said actuating member to a portion of said radius arm at positions spaced from the respective axes of pivotal mounting thereof.

7. A bow sight as defined in claim 5, wherein said track means is a cam surface adjustably positioned with respect to said frame whereby a given degree of rotation of said radius arm induces varying degrees of rotation of said sighting element according to the position adjustment of said cam surface.

8. A bow sight as defined in claim 4, additionally including an actuating member operative to rotate said radius arm with respect to said frame, said actuating member having a handle adjacent the position of said grip.

9. A bow sight as defined in claim 1, wherein said sighting element has a generally rectangular frame portion having opposite sides providing said spaced reference sections, the spacing therebetween corresponding to the apparent height of a target of known size at a known distance as viewed from the normal placement of the eye of an archer in shooting position.

10. A bow sight as defined in claim 9, wherein said frame portion is located above the axis of rotation of said sighting element.

* * * * *